US006475332B1

(12) United States Patent
Boyd et al.

(10) Patent No.: US 6,475,332 B1
(45) Date of Patent: Nov. 5, 2002

(54) INTERLOCKING CHEMICAL MECHANICAL POLISHING SYSTEM

(75) Inventors: John Boyd, Atascadero; Katgenahalli Y. Ramanujam, Fremont; Sridharan Srivatsan, Sunnyvale; Xuyen Pham, Fremont, all of CA (US)

(73) Assignee: Lam Research Corporation, Fremont, CA (US)

( * ) Notice: Subject to any disclaimer, the term of this patent is extended or adjusted under 35 U.S.C. 154(b) by 13 days.

(21) Appl. No.: 09/684,028

(22) Filed: Oct. 5, 2000

(51) Int. Cl.[7] ..... B24D 11/00; B24D 21/00

(52) U.S. Cl. ..... 156/345.12

(58) Field of Search ..... 156/345.12

(56) References Cited

U.S. PATENT DOCUMENTS 6,261,168 B1 * 7/2001 Jensen et al. ..... 451/527
6,296,557 B1 * 10/2001 Walker ..... 451/526
6,312,319 B1 * 11/2001 Donohue et al. ..... 451/56

* cited by examiner

*Primary Examiner*—Marian C. Knode
*Assistant Examiner*—Sylvia R. MacArthur
(74) *Attorney, Agent, or Firm*—Martine & Penilla, LLP

(57) ABSTRACT

An interlocking polishing belt apparatus is disclosed. The interlocking polishing belt apparatus includes an interlocking belt, which includes a plurality of studs each having an upper stud end and a lower stud end. In addition, the interlocking polishing belt apparatus includes a polishing belt that is in contact with the interlocking belt. The polishing belt has a plurality of polishing belt stud holes, each configured to interlock with an upper stud end.

13 Claims, 8 Drawing Sheets

INTERLOCKING CHEMICAL MECHANICAL POLISHING SYSTEM

This invention relates generally to chemical mechanical polishing, and more particularly to an interlocking polishing belt for use in a chemical mechanical polishing system.

BACKGROUND OF THE INVENTION

1. Field of the Invention

This invention relates generally to computer networking, and more particularly to network stack layer interfaces for efficiently communicating data between network stack layers in a computer network environment.

2. Description of the Related Art

In the fabrication of semiconductor devices, there is a need to perform Chemical Mechanical Polishing (CMP) operations, including polishing, buffing and wafer cleaning. Typically, integrated circuit devices are in the form of multi-level structures. At the substrate level, transistor devices having diffusion regions are formed. In subsequent levels, interconnect metallization lines are patterned and electrically connected to the transistor devices to define the desired functional device. As is well known, patterned conductive layers are insulated from other conductive layers by dielectric materials, such as silicon dioxide. As more metallization levels and associated dielectric layers are formed, the need to planarize the dielectric material increases. Without planarization, fabrication of additional metallization layers becomes substantially more difficult due to the higher variations in the surface topography. In other applications, metallization line patterns are formed in the dielectric material, and then metal CMP operations are performed to remove excess metallization.

In the prior art, CMP systems typically implement belt, orbital, or brush stations in which belts, pads, or brushes are used to scrub, buff, and polish one or both sides of a wafer. Slurry is used to facilitate and enhance the CMP operation. Slurry is most usually introduced onto a moving preparation surface, e.g., belt, pad, brush, and the like, and distributed over the preparation surface as well as the surface of the semiconductor wafer being buffed, polished, or otherwise prepared by the CMP process. The distribution is generally accomplished by a combination of the movement of the preparation surface, the movement of the semiconductor wafer and the friction created between the semiconductor wafer and the preparation surface.

FIG. 1 illustrates an exemplary prior art CMP system 10. The CMP system 10 in FIG. 1 is a belt-type system, so designated because the preparation surface is an endless belt 18 mounted on two drums 24 which drive the belt 18 in a rotational motion as indicated by belt rotation directional arrows 26. A wafer 12 is mounted on a carrier 14. The carrier 14 is rotated in direction 16. The rotating wafer 12 is then applied against the rotating belt 18 with a force F to accomplish a CMP process. Some CMP processes require significant force F to be applied. A platen 22 is provided to stabilize the belt 18 and to provide a solid surface onto which to apply the wafer 12. Slurry 28 composing of an aqueous solution such as $NH_4OH$ or DI containing dispersed abrasive particles is introduced upstream of the wafer 12. The process of scrubbing, buffing and polishing of the surface of the wafer is achieved by using an endless polishing pad glued to belt 18. Typically, the polishing pad is composed of porous or fibrous materials and lacks fix abrasives.

After the polishing pad polishes a limited number of wafers, the surface of the pad is conditioned or "dressed" in order to return the pad surface to the surface's original state. Subsequent conditioning, the polishing pad will generally have a significant amount of glazing, causing the polishing pad to lose effectiveness. The polishing pad also loses its effectiveness due to normal wear of the material itself. As a result, the polishing pad must be replaced in its entirety.

The removal of the used polishing pad and its subsequent replacement with a new polishing pad is very time consuming and labor intensive. Additionally, the time needed to perform the replacement necessarily requires that the polishing system be taken off-line, which thus reduces throughput.

To reduce the time needed to perform the pad replacement, efforts have been made to introduce a single-piece polymer belt into the CMP system. However, problems arise when using a single-piece polymer belt due to stretching of the belt, which causes the belt tension to change and introduces variability into the CMP process. Moreover, belt steering and endpoint detection window alignment problems occur for similar reasons.

In view of the foregoing, a need exists for a chemical mechanical polishing system that will enable use of a polishing pad that is less expensive to maintain and is more effectively serviced after its use degrades the effectiveness of the polishing. Moreover, the system should reduce belt steering and endpoint detection window alignment problems.

SUMMARY OF THE INVENTION

Broadly speaking, the present invention fills these needs by providing an interlocking CMP belt system. The interlocking CMP belt system of the present invention uses a single-piece polymer belt pad, thus greatly reducing the time needed for belt pad replacement. Further, interlocking CMP belt of the present invention greatly reduces belt steering and endpoint detection window alignment problems related to single-piece polymer belts.

In one embodiment, an interlocking polishing belt apparatus is disclosed. The interlocking polishing belt apparatus includes an interlocking belt, which includes a plurality of studs, each having an upper stud end and a lower stud end. In addition, the interlocking polishing belt apparatus includes a polishing belt that is in contact with the interlocking belt. The polishing belt has a plurality of polishing belt stud holes, each configured to interlock with an upper stud end.

In another embodiment, a method for performing chemical mechanical polishing utilizing an interlocking polishing belt is disclosed. Initially, an interlocking belt is provided that includes a plurality of studs, each having an upper stud end and a lower stud end. A polishing belt is then attached to the interlocking belt. The polishing belt includes a plurality of polishing belt stud holes each configured to interlock with an upper stud end.

An interlocking polishing belt system is disclosed in a further embodiment of the present invention. The interlocking polishing belt system includes at least one drum having a plurality of stud receiving holes. It should be noted that the system may actually include any number of drums, often two drums are used. The interlocking polishing belt system also includes an interlocking belt having a plurality of studs, each having an upper stud end and a lower stud end. The lower stud end of each stud is capable of being inserted into a stud receiving hole of the drum. Further, a polishing belt having an outer surface and an inner surface is included in the system. The polishing belt is in contact with the interlocking belt, and includes a plurality of polishing belt stud holes disposed within the inner surface. Each of the polishing belt stud holes is capable of interlocking with an upper stud end. Finally, a carrier capable of applying a wafer to the outer surface of the polishing belt is included in the system.

Advantageously, embodiments of the present invention allow the use a single-piece polishing pad belt, thus reducing the time needed for pad replacement. Further, embodiments of the present invention greatly reduce belt steering a endpoint detection window alignment problems. Other aspects and advantages of the invention will become apparent from the following detailed description, taken in conjunction with the accompanying drawings, illustrating by way of example the principles of the invention.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE PREFERRED EMBODIMENTS

An invention is disclosed for an interlocking CMP belt system. The interlocking CMP belt system of the present invention uses a single-piece polymer belt pad, thus greatly reducing the time needed for belt pad replacement. Further, interlocking CMP belt of the present invention greatly reduces belt steering and endpoint detection window alignment problems related to single-piece polymer belts.

In the following description, numerous specific details are set forth in order to provide a thorough understanding of the present invention. It will be apparent, however, to one skilled in the art that the present invention may be practiced without some or all of these specific details. In other instances, well known process steps have not been described in detail in order not to unnecessarily obscure the present invention.

Figure 1:
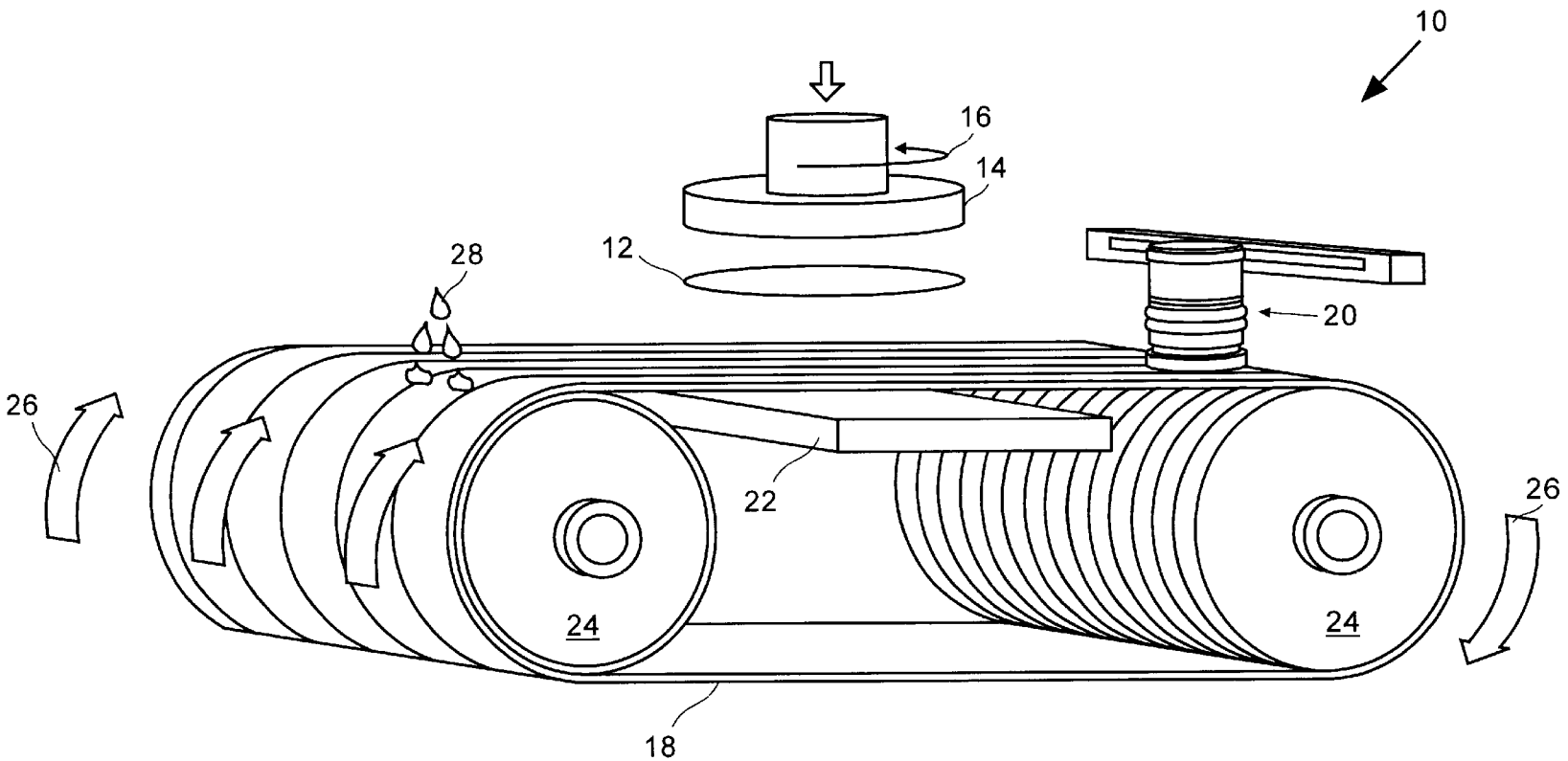
FIG. 1 (prior art)
FIG. 1 is an illustration showing an exemplary prior art CMP system.
Figure 2:
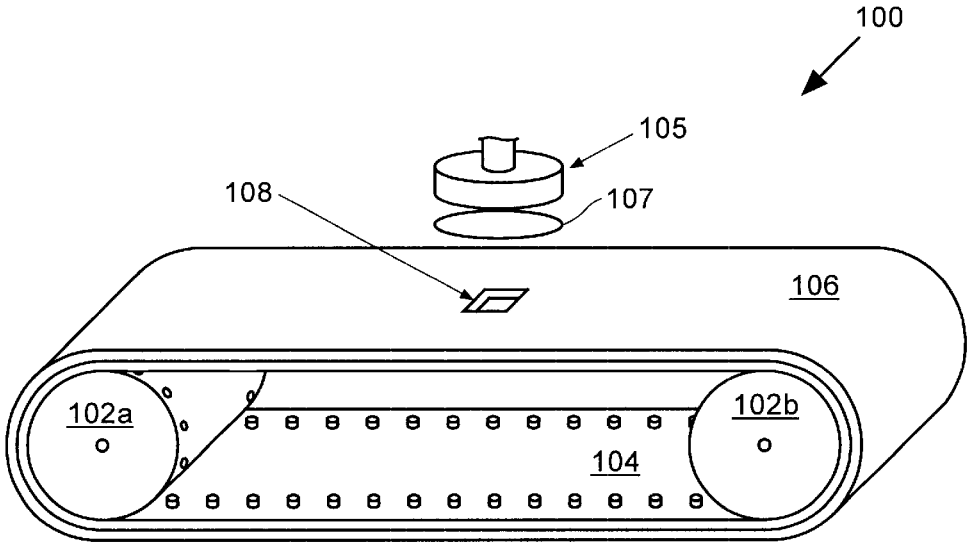
FIG. 2 shows a three-dimensional diagram of a chemical mechanical polishing system, in accordance with one embodiment of the present invention.

FIG. 2 shows a three-dimensional diagram of a chemical mechanical polishing (CMP) system 100, in accordance with one embodiment of the present invention. The CMP system 100 includes a pair of drums 102*a* and 102*b*, an interlocking stainless steel belt 104, and a polishing belt 106. The interlocking stainless steel belt 104 and the polishing belt 106 each have respective endpoint detection windows 108, which are used during the polishing operations of a semiconductor wafer to determine when the endpoint of a polishing operation has been reached.

In addition, the CMP system 100 can include a number of other components typically integrated into a full-scale CMP system, such as an air bearing that sits between the drums 102 and the interlocking stainless steel belt 104, and polishing belt 106. The CMP system 100 also generally includes a carrier 105 for applying a wafer 107 to the surface of the polishing belt 106 during normal operation.

As is well known, the polishing belt 106 and the interlocking stainless steel belt 104 are configured to rotate in an endless loop during a CMP operation to enable the removal of particular layers or materials from the surface of the semiconductor wafer 107. In addition, to facilitate the polishing operation of the semiconductor wafer 107 and to enhance planarity, the polishing belt 106 typically is provided with a slurry material.

Figure 3:
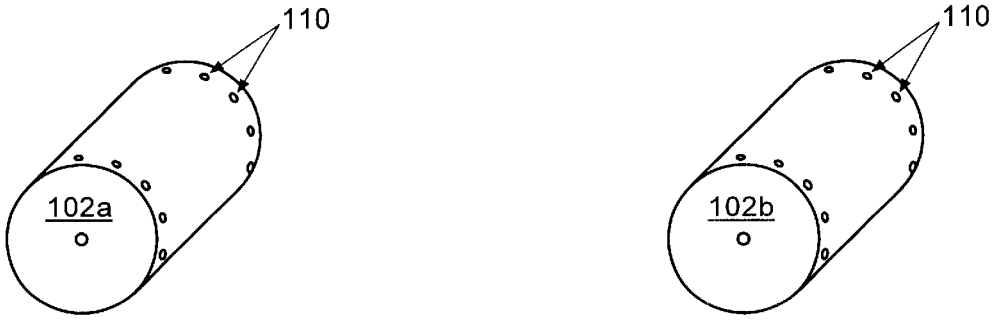
FIG. 3 is an illustration showing drums, which are configured to assist in the rotation of the interlocking stainless steel belt and the polishing belt.

FIG. 3 shows in more detail, drums 102*a* and 102*b*, which are configured to assist in the rotation of the interlocking stainless steel belt 104 and the polishing belt 106, in accordance with one embodiment of the present invention. Drums 102*a* and 102*b* each include a plurality of stud receiving holes 110 arranged along the periphery of each drum. The stud receiving holes are configured to receive a plurality of studs manufactured in or with the interlocking stainless steel belt 104, described in greater detail subsequently. The drums 102*a* and 102*b* are further configured to assist in driving the interlocking stainless steel belt 104 and the polishing belt 106 together as they rotate around the drums 102*a* and 102*b*. In one embodiment, the drums 102*a* and 102*b* include a manufactured layer that is applied to the surface of the drums to enable the formation of the stud receiving holes 110. The stud receiving holes 110 can be defined in any shape so long as depressions are provided for driving the interlocking stainless steel belt 104 as will be described below.

Figure 4:
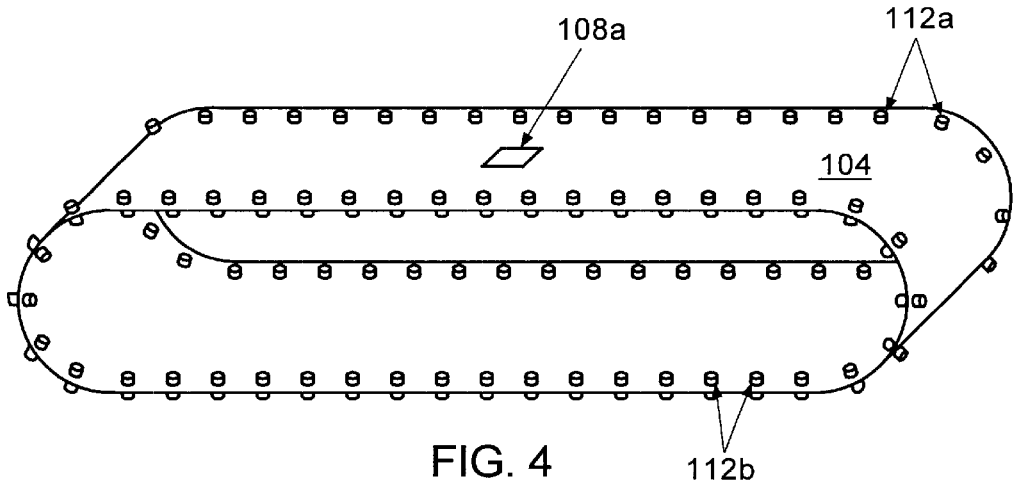
FIG. 4 is an illustration showing an interlocking stainless steel belt, in accordance with one embodiment of the present invention.

FIG. 4 is an illustration showing an interlocking stainless steel belt 104, in accordance with one embodiment of the present invention. The interlocking stainless steel belt 104 may preferably include an endpoint detection window 108*a*. Of course, other embodiments that do not perform endpoint detection can omit the endpoint detection window 108*a* if appropriate. As shown, the interlocking stainless steel belt 104 includes a plurality of studs 112. Each of the plurality of studs 112 are shown having respective upper stud ends

112*a* and lower stud ends 112*b*. In a preferred embodiment, the lower stud ends 112*b* are configured to mate with each of the stud receiving holes 110 in the surface of the drums 102*a* and 102*b*. The interlocking stainless steel belt 104 also utilizes the upper stud ends 112*a* to provide a mating mechanism for receiving the polishing belt 106.

Figure 5:
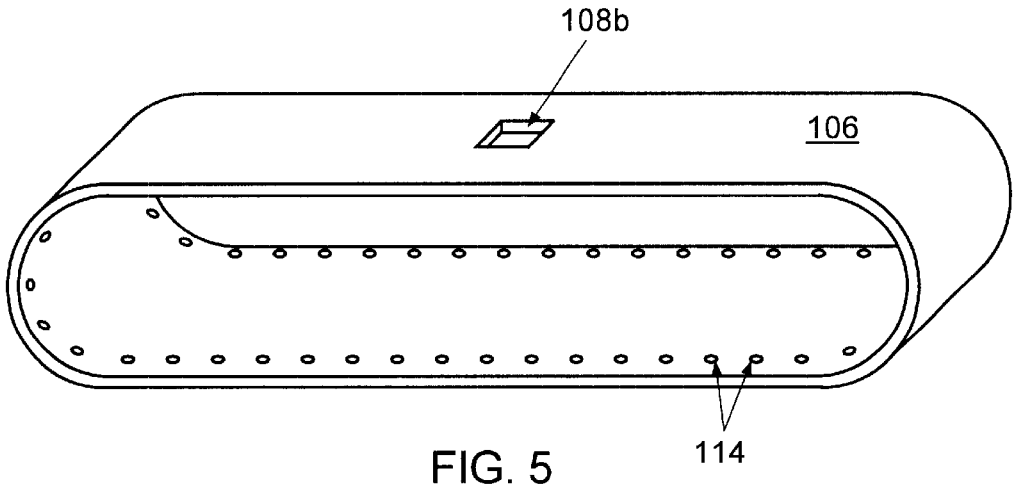
FIG. 5 is an illustration showing a polishing belt, in accordance with an embodiment of the present invention.

FIG. 5 is an illustration showing a polishing belt 106, in accordance with an embodiment of the present invention. As shown in FIG. 5, the polishing belt 106 includes a plurality of polishing belt stud holes 114 disposed in the inner surface of the polishing belt 106. Each of the plurality of polishing belt stud holes 114 are designed to mate with each of the respective upper stud ends 112*a* of the interlocking stainless steel belt 104. In this manner, the polishing belt 106 can be mounted onto the interlocking stainless steel belt 104 by simply attaching the polishing belt 106 onto the interlocking stainless steel belt 104 in a manner that mates each of the polishing belt stud holes 114 with the upper stud ends 112*a*.

As mentioned above, by providing the interlocking stainless steel belt 104 having the plurality of upper stud ends 112*a*, polishing belts 106 can be easily replaced when the useful life of the polishing belt 106 has reached its end. By way of example, the polishing belt 106 will experience wear as polishing operations are performed on semiconductor wafers 107.

Another notable advantage of the polishing belt 106 and interlocking stainless steel belt 104 arrangement is that the polishing belt stud holes 114 prevent the polishing belt endpoint detection window 108*b* from slipping to a location that is no longer over the interlocking stainless steel endpoint detection window 108*a*. Yet a further benefit of the precision joining of the polishing belt stud holes 114 and the upper stud ends 112*a* is that the polishing belt 106 will not steer off-track during polishing operations. As mentioned above, a problem exists in the prior art where the polishing belt 106 may steer off from its original placement.

Figure 6:
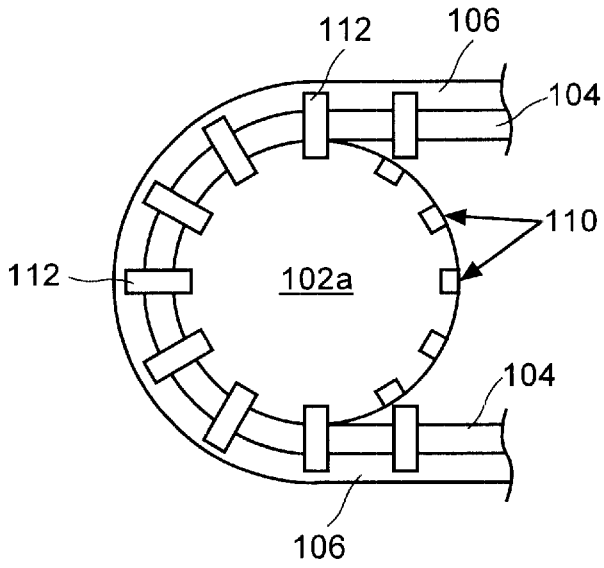
FIG. 6 is a diagram showing a drum having a plurality of stud receiving holes, in accordance with an embodiment of the present invention.

FIG. 6 is a more detailed diagram of the drum 102*a* having a plurality of stud receiving holes 110. The stud receiving holes 110 in combination with the interlocking stainless steel belt 104, and the studs 112 assist in providing the proper amount of drive to the polishing belt 106 during operation. Yet another advantage of the present invention is that the polishing belt 106 is prevented from stretching during operation due to the fact that the polishing belt 106 is held in position all the way around the tracks by way of the upper stud ends 112*a*.

Figure 7A:
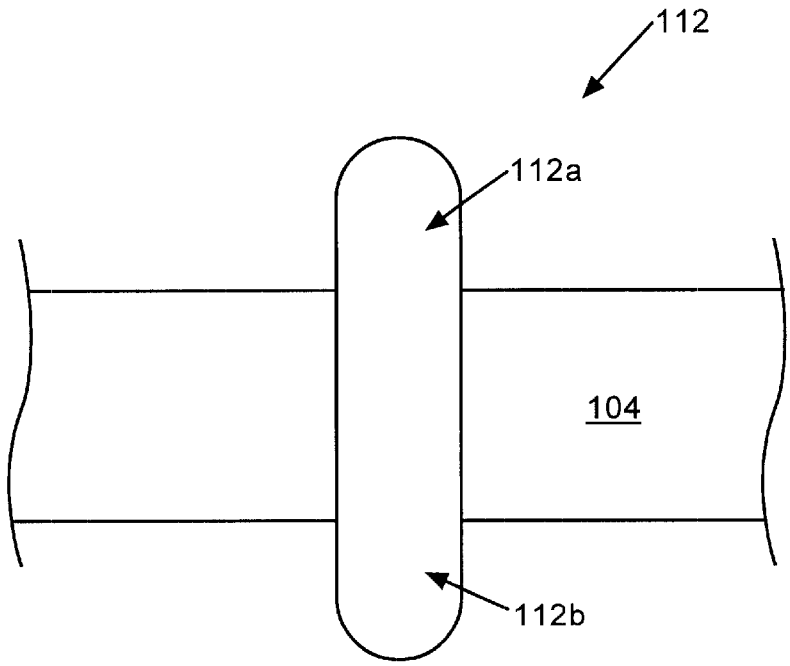
FIG. 7A is an illustration showing a stud being integrated into the interlocking stainless steel belt, in accordance with an embodiment of the present invention.
Figure 7B:
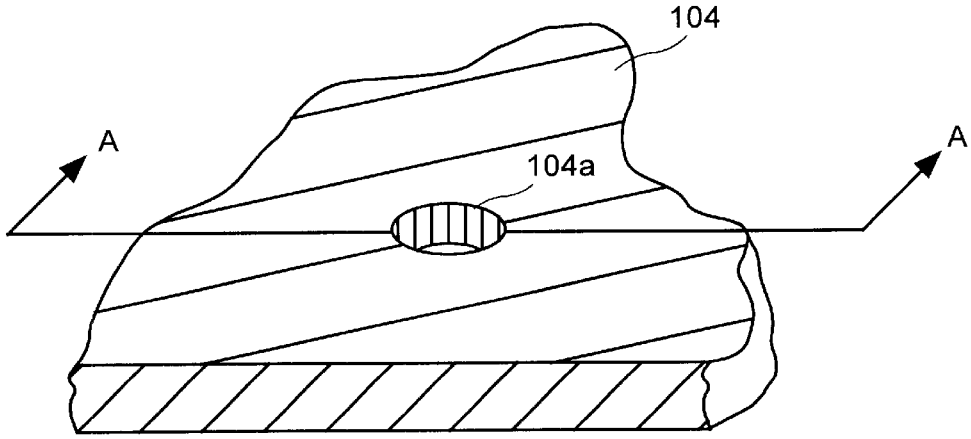
FIG. 7B is an illustration showing a cutout view of the interlocking stainless steel belt and a cross-section A—A, in accordance with an embodiment of the present invention.
Figure 7C:
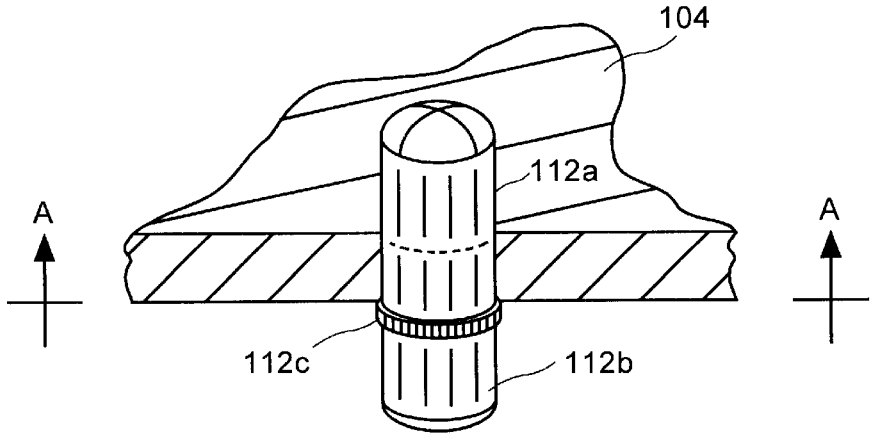
FIG. 7C is an illustration showing a stud having a stop ring, in accordance with an embodiment of the present invention.

FIG. 7A illustrates a more detailed diagram of the studs 112 being integrated into the interlocking stainless steel belt 104. As shown, the studs 112 have respective upper studs ends 112*a* and lower stud ends 112*b*. In one example, the studs 112 can be inserted into holes formed into the interlocking stainless steel belt 104. To ensure that the studs 112 remain in the interlocking stainless steel belt 104, it is preferred that the holes provide a tight fit for the studs 112 once inserted into position. FIG. 7B illustrates a cutout view of the interlocking stainless steel belt 104 and a cross-section A—A. The interlocking stainless steel belt 104 also includes a interlocking stainless steel stud hole 104*a*. In another embodiment, the studs 112 can include a stop ring 112*c* as shown in FIG. 7C. The stop ring 112*c* is configured to prevent the studs 112 from traversing through the interlocking stainless steel belt 104 once inserted into the interlocking stainless steel stud holes 104*a*. In this embodiment, the studs 112 also are preferred to have a semispherical top end to provide for easy mating of the polishing belts 106 and into the stud receiving holes 110 of the drums 102 during operation.

Figure 7D:
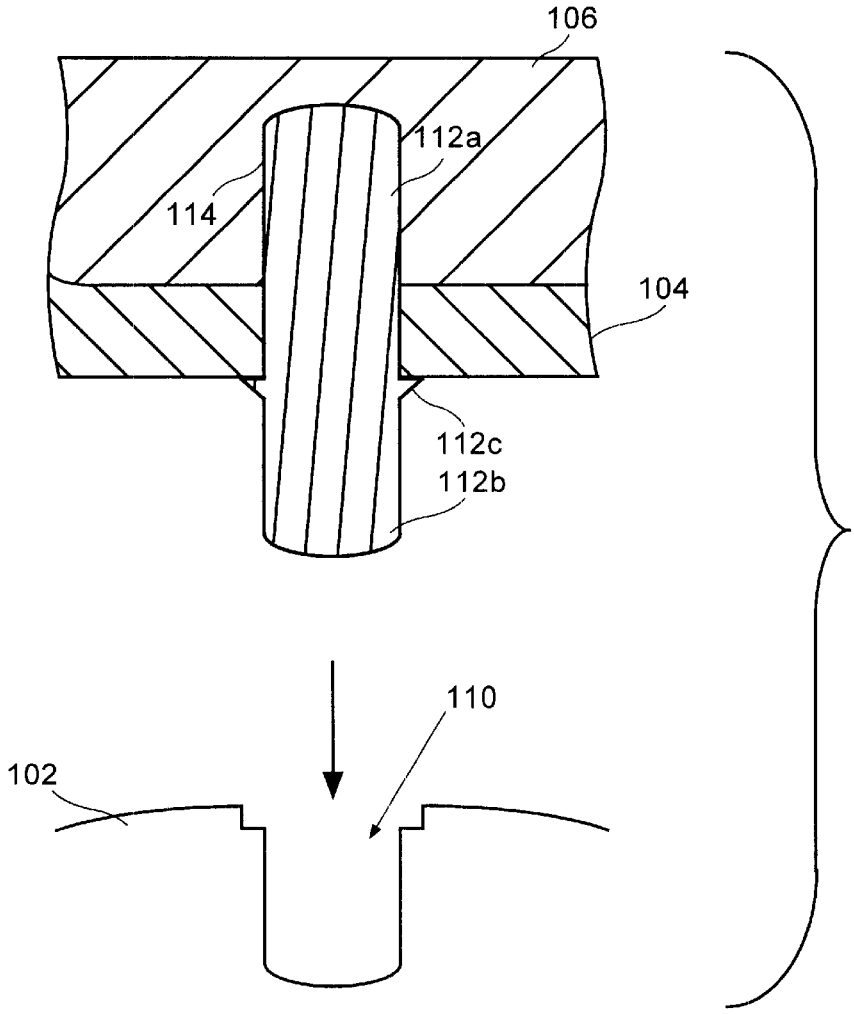
FIG. 7D is an illustration showing a cross-sectional view of a stud having the upper stud end inserted through the interlocking stainless belt and the polishing belt, in accordance with an embodiment of the present invention.

FIG. 7D illustrates a cross-sectional view of a stud 112 having the upper stud end 112*a* inserted through the interlocking stainless belt 104 and the polishing belt 106. As shown, the upper stud end 112*a* is inserted into a polishing belt stud hole 114 and provides a proper substantially non-slip interconnection for the polishing belt 106. FIG. 7D also illustrates the stop ring 112*c* which mates with a surface of the interlocking stainless steel belt 104 and prevents the stud 112 from continuing to slide up and potentially protrude too far into the polishing belt 106. It should be noted that the stop ring 112*c* can also prevent surface abnormalities from occurring over the polishing belt 106 during operation. The lower stud end 112*b* is also configured and shown to insert into the stud receiving hole 110 of the drum 102.

Figure 7E:
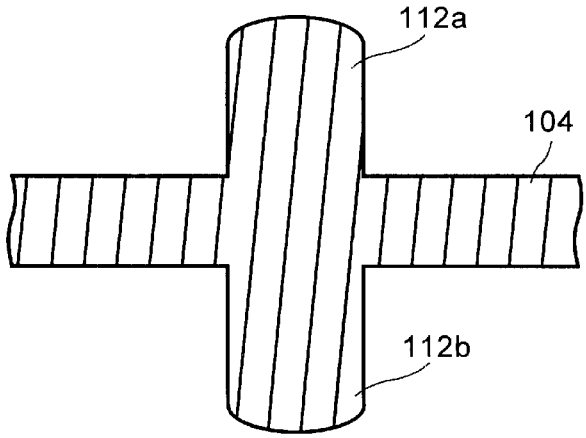
FIG. 7E is an illustration showing a stud that is integral with the interlocking stainless steel belt, in accordance with an embodiment of the present invention.

FIG. 7E shows yet another example of the stud 112 being integral with the interlocking stainless steel belt 104. As shown, the upper stud end 112*a* and the lower stud end 112*b* can potentially be made integral with the interlocking stainless steel belt 104 and thus formed from stainless steel. It is also noted that the studs 112 of FIGS. 7A, 7C, and 7D can be made from other materials that provide sufficient strength for driving the interlocking stainless steel belt 104 and the polishing belt 106, such as PET, PEEK, and VESPEL.

Figure 8:
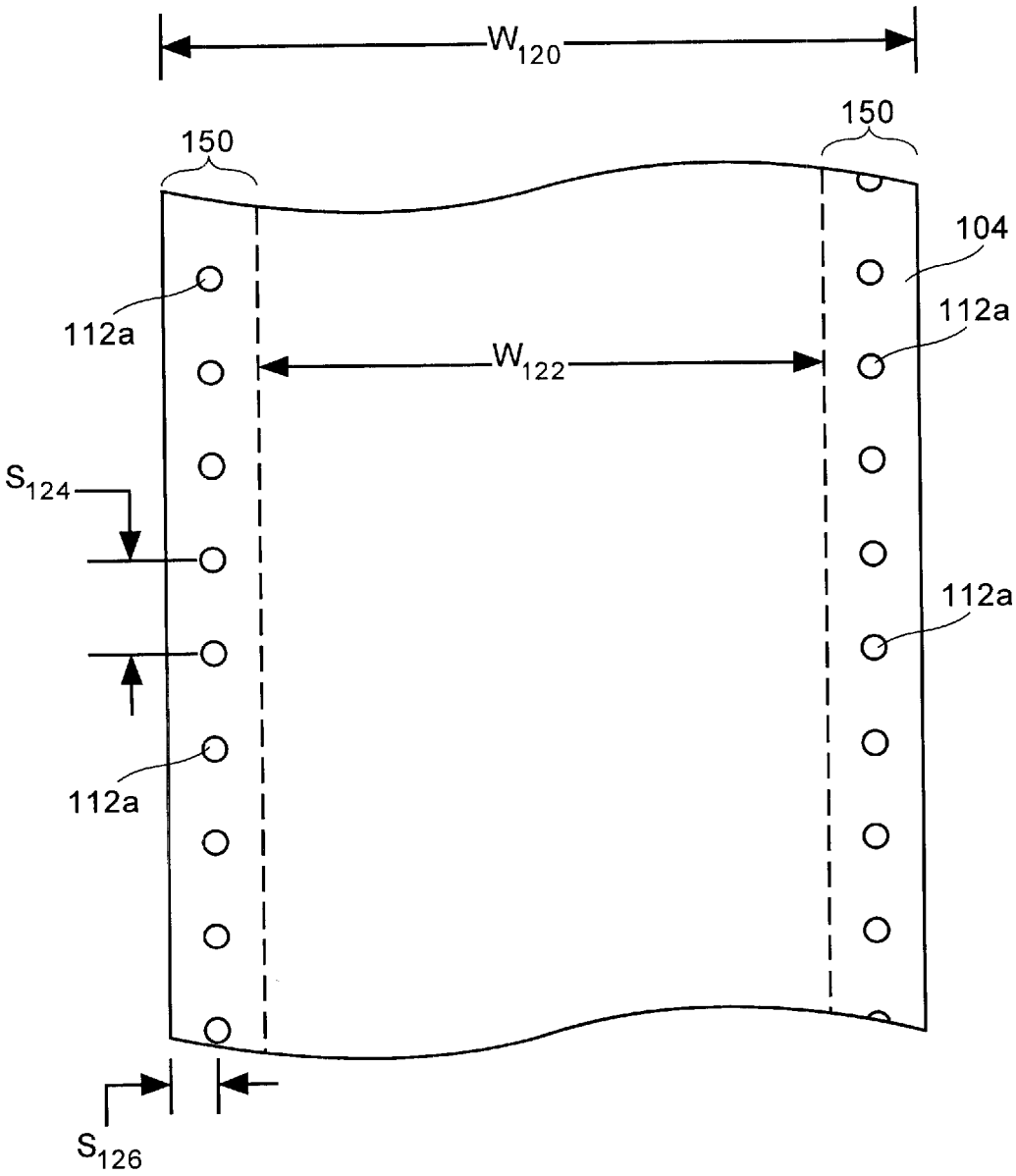
FIG. 8 is an illustration showing a top partial view of a interlocking stainless steel belt, in accordance with one embodiment of the present invention.

FIG. 8 shows a top partial view of the interlocking stainless steel belt 104, in accordance with one embodiment of the present invention. The interlocking stainless steel belt 104 preferably includes a plurality of upper stud ends 112*a* aligned along stud tracks 150. The stud track 105 is preferably designed to be arranged outside of a width $W_{122}$ which defines the region over which a wafer will be applied to the polishing belt 106 once the polishing belt 106 is applied to the interlocking stainless steel belt 104.

In one example, the plurality of upper stud ends 112*a* are separated by a preferred separation $S_{124}$ that ranges between about one inch and about six inches, and most preferably, about 2 inches. Within the stud tracks 150, the upper stud ends 112*a* are arranged such that a separation is maintained from the outer edge of the interlocking stainless steel belt 104. In one preferred embodiment, the separation of the upper stud ends 112*a* can be between about half an inch and about one and one-half inch, and most preferably, about one inch for a 200 mm CMP system.

For a 300 mm CMP system, the separation $S_{126}$ is preferably between about one-fourth inch and about three-fourths inch, and most preferably, about one-half inch. Of course, this separation $S_{126}$ can vary so long as the upper stud ends 112 are arranged outside of a wafer path defined by the width $W_{122}$. For example, for a 200 mm wafer CMP system, the width $W_{122}$ should be no smaller than about 8 inches, and for a 300 mm CMP system, the width $W_{122}$ should be no less than about 12 inches.

Figure 9A:
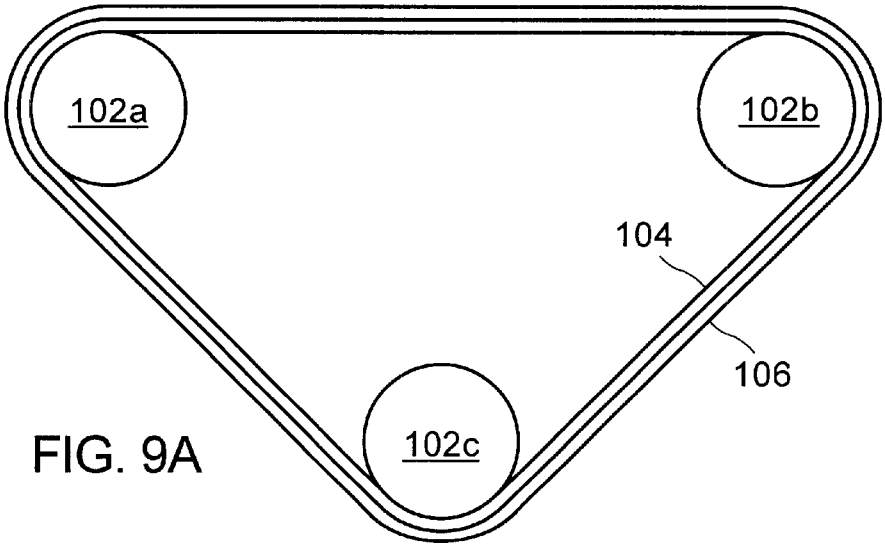
FIG. 9A is an illustration showing a CMP belt system having three drums, in accordance with an embodiment of the present invention.
Figure 9B:
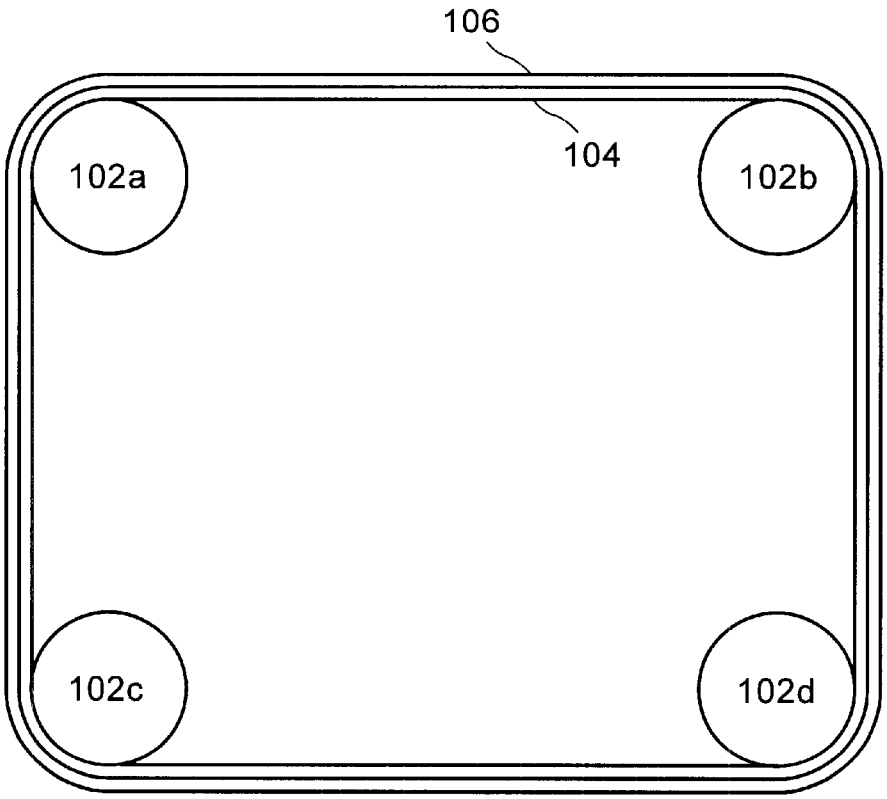
FIG. 9B is an illustration showing a CMP belt system having four drums, in accordance with an embodiment of the present invention.

FIGS. 9A and 9B illustrate alternative embodiments of the present invention. In FIG. 9A, three drums 102*a*, 102*b*, and 102*c* are arranged in a triangular orientation in a manner that circulates the polishing belt 106 and the interlocking stainless steel belt 104 around each of the drums 102. In FIG. 9B, the orientation implements a first drum 102*a*, a second drum 102*b*, a third drum 102*c*, and a fourth drum 102*d*. Each of the drums 102 are arranged in a square or a rectangular orientation, and are configured to mate with the interlocking stainless steel belt 104 and the polishing belt 106 in a manner that implements the studs 112 of the embodiments described above.

Accordingly, it should be understood that the actual arrangement of the CMP system 100 can change so long as the interlocking stainless steel belt 104 implements a plurality of studs 112 which are designed to prevent the polishing belt 106 from slipping and thus, shifting during operation. It is also important to note that the polishing belt 106 can easily be replaced by removing a used or expired polishing belt 106 from the upper stud end 112*a* and then re-inserting a new fresh polishing belt 106 over the interlocking stainless steel belt 104 in a manner that joins the polishing belt stud holes 114 with respective upper stud ends 112*a* of the interlocking stainless steel belt 104.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. In a chemical mechanical polishing system, an interlocking polishing belt apparatus, comprising:

an interlocking belt having a plurality of studs, each stud comprising an upper stud end and a lower stud end; and a polishing belt in contact with the interlocking belt, the polishing belt having a plurality of polishing belt stud holes, wherein each of the polishing belt stud holes is capable of interlocking with an upper stud end.

2. An interlocking polishing belt apparatus as recited in claim 1, further comprising a drum in contact with the interlocking belt, the drum having a plurality of stud receiving holes, wherein each of the stud receiving holes is capable of receiving a lower stud end.

3. An interlocking polishing belt apparatus as recited in claim 2, wherein the interlocking belt has an opening capable of allowing endpoint detection through the interlocking belt.

4. An interlocking polishing belt apparatus as recited in claim 3, wherein the polishing belt has an opening capable of allowing endpoint detection through the polishing belt.

5. An interlocking polishing belt apparatus as recited in claim 1, wherein each upper stud end and lower stud end form a single stud.

6. An interlocking polishing belt apparatus as recited in claim 1, wherein each upper stud end and lower stud end are integral to the interlocking belt.

7. An interlocking polishing belt apparatus as recited in claim 1, further comprising a plurality of stop rings, each stop ring being coupled to a lower stud end.

8. In a chemical mechanical polishing system, an interlocking polishing belt system, comprising:

at least one drum having a plurality of stud receiving holes;

an interlocking belt having a plurality of studs, each stud comprising an upper stud end and a lower stud end, wherein the lower stud end of each stud is capable of being inserted into a stud receiving hole of the drum;

a polishing belt in contact with the interlocking belt, the polishing belt having an outer surface and an inner surface, the polishing belt further having a plurality of polishing belt stud holes disposed within the inner surface, wherein each of the polishing belt stud holes is capable of interlocking with an upper stud end; and a carrier capable of applying a wafer to the outer surface of the polishing belt.

9. An interlocking polishing belt system as recited in claim 8, wherein the interlocking belt includes an opening capable of allowing endpoint detection through the interlocking belt.

10. An interlocking polishing belt system as recited in claim 9, wherein the polishing belt includes an opening capable of allowing endpoint detection through the polishing belt.

11. An interlocking polishing belt system as recited in claim 8, wherein each upper stud end and lower stud end form a single stud.

12. An interlocking polishing belt system as recited in claim 8, wherein each upper stud end and lower stud end are integral to the interlocking belt.

13. An interlocking polishing belt system as recited in claim 8, further comprising a plurality of stop rings, each stop ring being coupled to a lower stud end.

* * * * *